US007278250B2

(12) United States Patent
Kawakami

(10) Patent No.: US 7,278,250 B2
(45) Date of Patent: Oct. 9, 2007

(54) SLICED BREAD PACKAGING METHOD AND EQUIPMENT

(75) Inventor: Sanji Kawakami, Tsurugashima (JP)

(73) Assignee: Daisey Machinery Co., Ltd., Saitama-ken (JP)

( * ) Notice: Subject to any disclaimer, the term of this patent is extended or adjusted under 35 U.S.C. 154(b) by 141 days.

(21) Appl. No.: 11/171,450

(22) Filed: Jul. 1, 2005

(65) Prior Publication Data

US 2006/0000333 A1 Jan. 5, 2006

(30) Foreign Application Priority Data

Jul. 5, 2004 (JP) ..... 2004-198173

(51) Int. Cl.
*B65B 35/30* (2006.01)

(52) U.S. Cl. ..... 53/443; 53/147; 53/446; 53/516

(58) Field of Classification Search ..... 53/147, 53/443, 446, 516, 543, 544, 447
See application file for complete search history.

(56) References Cited

U.S. PATENT DOCUMENTS 1,969,004 A * 8/1934 Hartman ..... 53/516
2,044,902 A * 6/1936 Ferenci ..... 83/102.1
2,211,433 A * 8/1940 Papendick ..... 83/105
2,247,692 A * 7/1941 Papendick ..... 83/26
2,247,694 A * 7/1941 Papendick ..... 83/105
2,247,695 A * 7/1941 Papendick ..... 198/442
2,332,316 A * 10/1943 Hexter et al. ..... 53/516
2,389,812 A * 11/1945 Papendick ..... 198/431
2,632,985 A * 3/1953 Schmitt ..... 53/147
5,680,743 A * 10/1997 Hoekzema ..... 53/446
6,520,314 B1 * 2/2003 Seiling ..... 198/375
2003/0037516 A1 * 2/2003 Rompa ..... 53/516

FOREIGN PATENT DOCUMENTS

JP 2000-219316 8/2000

* cited by examiner

*Primary Examiner*—Thanh Truong
(74) *Attorney, Agent, or Firm*—Wenderoth, Lind & Ponack, L.L.P.

(57) ABSTRACT

Sliced bread packaging method and equipment enable that sliced bread units, each unit having different predetermined numbers of bread slices, are smoothly supplied into a same one packaging apparatus. Sliced bread is conveyed in a standing state by a sliced bread feed-in conveyor to be fed in a first supply path conveying the sliced bread of one pound in the standing state, or in a second supply path conveying the sliced bread of a half pound in the standing state. The sliced bread of the one pound on the first supply path is discharged as it is on a sliced bread receiving path of the packaging apparatus. The sliced bread of the half pound on the second supply path is received by an upsetting device to be turned by 90° into a laying condition and is supplied into the packaging apparatus in this turned state. By so changing over feed of the sliced bread using the first and second supply paths, sliced bread is easily changed over according to numbers of bread slices to be smoothly packaged by the same packaging apparatus.

20 Claims, 3 Drawing Sheets

SLICED BREAD PACKAGING METHOD AND EQUIPMENT

BACKGROUND OF THE INVENTION

1. Field of the Invention

The present invention relates to a sliced bread packaging method and equipment for packaging sliced bread according to units of sliced bread having different predetermined numbers of bread slices.

2. Description of the Related Art

In case of packaging bread, the bread is often cut into slices, each slice having a predetermined thickness, and units of sliced bread of a predetermined quantity, such as one pound, a half pound, a quarter pound, etc., are packaged in bags for sale. For this purpose, it is demanded that one packaging equipment can change over the units of the sliced bread to be packaged according to a quantity of one pound, a half pound, a quarter pound, etc. so that the sliced bread of any number of slices can be smoothly packaged.

In order to realize such demand, such a sliced bread packaging method is desired that the number of slices to be packaged can be easily changed over and the sliced bread having any number of slices can be smoothly fed into packaging equipment. Also, desired is sliced bread packaging equipment of a simple structure realizing such a sliced bread packaging method.

In conventionally proposed sliced bread packaging method and apparatus, at each time of changing a feed quantity (the number of slices) of sliced bread, it is needed to change a setting of a sliced bread conveying part for changing the feed quantity or to make an adjustment after changing the setting. Also, there is a problem that while smooth packaging is performed if the number of bread slices is a large number, no smooth packaging can be performed if the number of bread slices is a small number as the bread slices of the small number are easily deformed.

As one example of a conventional packaging apparatus in which packaging is performed according to a quantity of sliced bread (number of slices), there is one disclosed by Patent Document 1 mentioned below, in which, at each time of changing the number of bread slices to be packaged, it is needed to change a position of a stopper guide and to make an adjustment so that bread slices of a selected number are smoothly introduced into packaging steps, and this requires considerable time and skill for such change-over operation.

Patent Document 1: Japanese laid-open patent application 2002-219316

SUMMARY OF THE INVENTION

In view of the problems in the prior art sliced bread packaging method and apparatus, it is an object of the present invention to provide a sliced bread packaging method by which units of sliced bread, each unit having different predetermined numbers of bread slices, are easily changed over so that a smooth and stable packaging of sliced bread is enabled. Also, it is an object of the present invention to provide sliced bread packaging equipment having a simple structure appropriate for realizing such sliced bread packaging method.

As a sliced bread packaging method that achieves the above-mentioned object, the present invention provides a sliced bread packaging method characterized in that one or more of first units of sliced bread, each of the first units having a first plurality of bread slices, to be supplied in a sliced bread standing state, and one or more of second units of sliced bread, each of the second units having a second plurality of bread slices, to be supplied in a sliced bread sideways turned state, with the second plurality being less than the first plurality, are changed over to each other so that the sliced bread of either of the first units and the second units is fed into a same one sliced bread packaging apparatus to be packaged.

Also, as sliced bread packaging equipment that achieves the above-mentioned object, the present invention provides sliced bread packaging equipment characterized in comprising: a sliced bread feed-in device supplying sliced bread in a sliced bread standing state; a sliced bread supply path having a first supply path receiving and conveying one or more of first units of the sliced bread in the sliced bread standing state fed in by the sliced bread feed-in device, with each of the first units having a first plurality of bread slices; and a second supply path receiving and conveying one or more of second units of a sliced bread in the sliced bread standing state fed in by the sliced bread feed-in device, with each of the second units having a second plurality of bread slices, and with the second plurality being less than the first plurality; and an upsetting device receiving and turning into a laying condition the second units supplied from the second supply path, and being constructed such that the sliced bread supplied via either of the first supply path or the second supply path and the upsetting device is fed into a same one sliced bread packaging apparatus.

In the sliced bread packaging equipment of the present invention, it is preferable that the upsetting device is a rotating upsetting device that comprises a plurality of sections receiving the sliced bread in the sliced bread standing state supplied from the second supply path so that at each time when the upsetting device is rotated by a predetermined angle, the sliced bread received in one of the sections is turned into a laying condition.

Also, in the sliced bread packaging equipment of the present invention, it is preferable that the sliced bread of each of the first units supplied onto the first supply path is of one pound and the sliced bread of each of the second units supplied onto the second supply path is of a half pound.

Also, it is preferable that sliced bread packaging equipment of the present invention is constructed such that the first supply path is arranged to be aligned with a sliced bread receiving path of the sliced bread packaging apparatus, and the sliced bread supplied from the second supply path via the upsetting device is discharged at an outlet portion of the first supply path.

According to the sliced bread packaging method of the present invention, the first units of the sliced bread having the first plurality of the bread slices to be supplied in the standing state of the sliced bread, and the second units of the sliced bread having the second plurality of the bread slices, with the second plurality being less than the first plurality, to be supplied in the state that the sliced bread is turned sideways can be easily changed over to each other. At this time, if the number of bread slices is large so that the sliced bread can maintain standing, the sliced bread is supplied as it is in the standing state, but if the number of bread slices is small so that the sliced bread can hardly maintain standing, the sliced bread is supplied in a sideways turned state of the sliced bread. Then, the sliced bread of either of the first units and the second units can be fed into the same sliced bread packaging apparatus. Thus, in both cases of a large number of bread slices and a lesser number of bread slices, by simply changing over the supply of the sliced bread between the first units and the second units, the sliced bread can be supplied in a stable manner to be packaged.

Also, according to the sliced bread packaging equipment of the present invention, the sliced bread supply path comprises the first supply path and the second supply path. The first supply path conveys the first units of the sliced bread, having the first plurality of the bread slices, in the standing state of the sliced bread fed in by the sliced bread feed-in device. The second supply path conveys the second units of the sliced bread, having the second plurality of the bread slices, in the standing state of the sliced bread fed in by the sliced bread feed-in device, wherein the second plurality is less than the first plurality. As supply of the sliced bread onto the first supply path and the second supply path can be easily changed over to each other, in both cases of the large number of the bread slices and the lesser number of the bread slices, the sliced bread can be supplied in a stable manner to be packaged by the same packaging apparatus.

Moreover, in the sliced packaging equipment of the present invention, as the second units of the sliced bread, having the fewer number of bread slices, conveyed from the second supply path is turned into a laying condition by the upsetting device to be supplied into the sliced bread packaging apparatus, even sliced bread that is too soft because of fewer number of bread slices to maintain self-standing can be fed into the packaging apparatus in a stable manner to be packaged.

Also, in the sliced bread packaging equipment of the present invention, as construction is made such that sliced bread conveyed via either of the first supply path and the second supply path and upsetting device is fed as it is into the same packaging apparatus, an entire structure can be simplified.

Further, in the sliced bread packaging equipment of the present invention, it is preferable that the upsetting device includes a structure comprising a plurality of sections receiving the sliced bread in the standing state of the sliced bread supplied from the second supply path. Thereby, at each time when the upsetting device is rotated by a predetermined angle, the sliced bread received in one of the sections can be stably turned into a laying condition.

In the sliced bread packaging equipment of the present invention, it is preferable that the sliced bread of each of the first units supplied onto the first supply path is of one pound, and the sliced bread of each of the second units supplied onto the second supply path is of a half pound. Thereby, sliced bread packaging equipment that can receive both of feed of the sliced bread of one pound, that is a most usual distribution mode in this country, and a half pound can be obtained.

Also, in the sliced bread packaging equipment of the present invention, the construction is preferably made such that the first supply path is arranged to be aligned with a sliced bread receiving path of the sliced bread packaging apparatus, and the sliced bread supplied from the second supply path via the upsetting device is discharged at the outlet portion of the first supply path. Thereby, the sliced bread supplied from the second supply path via the upsetting device can be efficiently supplied into the sliced bread packaging apparatus from the outlet portion of the first supply path.

DETAILED DESCRIPTION OF THE PREFERRED EMBODIMENTS

Herebelow, a sliced bread packaging method and equipment according to the present invention will be described based on an embodiment shown in FIGS. 1 and 2.

Figure 1:
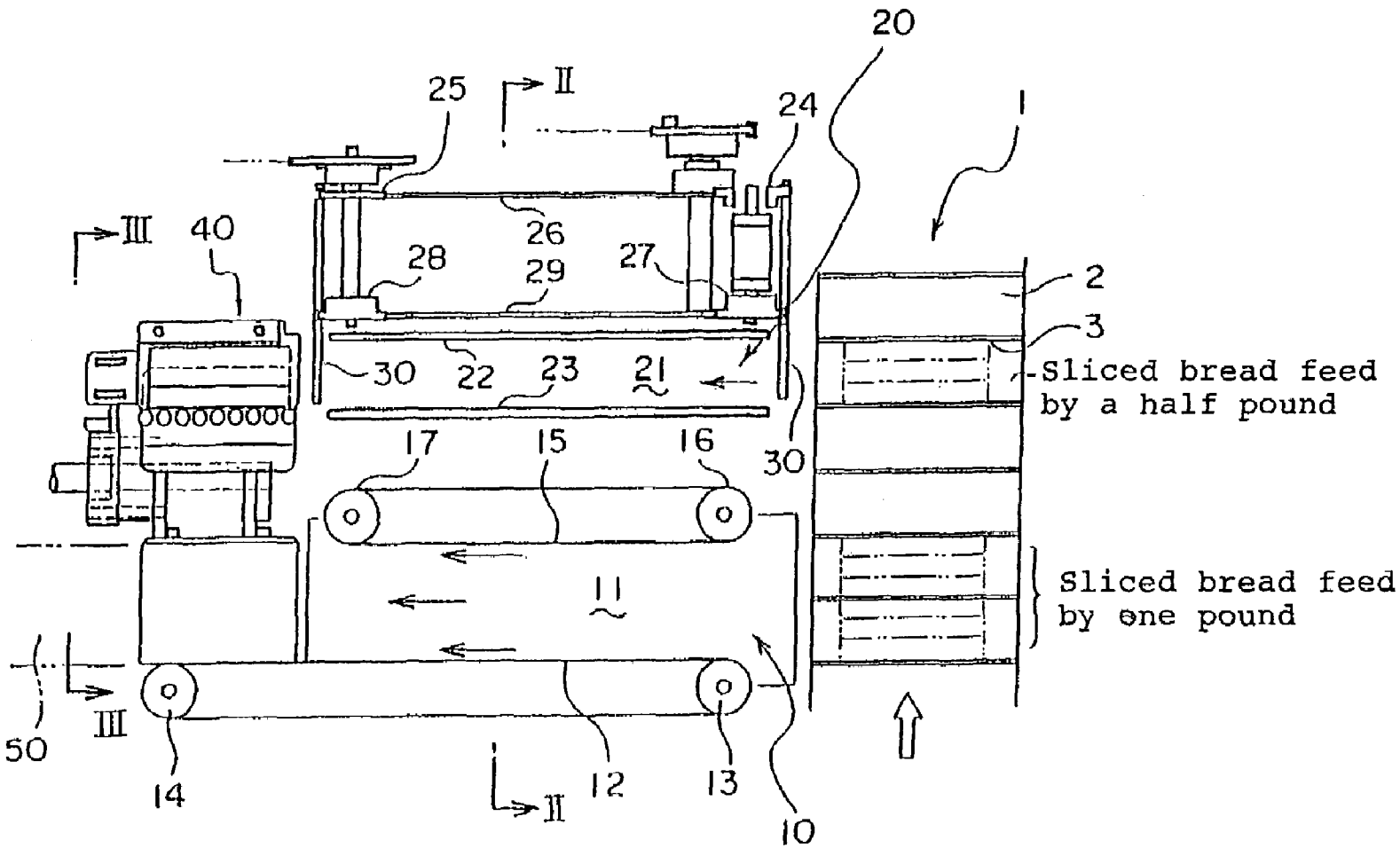
FIG. 1 is a plan view showing an entire construction of sliced bread packaging equipment of an embodiment according to the present invention.

FIG. 1 is a plan view showing an entire construction of the sliced bread packaging equipment of the embodiment according to the present invention. In FIG. 1, numeral 1 designates a sliced bread feed-in conveyor. This feed-in conveyor 1 is of an endless belt type having a chain to which a plurality of receiving plates 2 are fitted being arrayed. Each of the receiving plates 2 has such a plate width in a feed-in conveyor running direction shown by a white bold arrow in FIG. 1 that sliced bread of a half pound having a predetermined unit number of bread slices (three slices, for example) can be conveyed in a standing state of the sliced bread.

The feed-in conveyor 1 is constructed to be driven by a chain wheel or the like to run in the feed-in conveyor running direction. Also, a partitioning plate 3, having an appropriate height, is provided standing between adjacent receiving plates 2 for supporting the sliced bread placed on the receiving plates 2 so that the sliced bread may not fall aside.

The feed-in conveyor 1 constitutes a sliced bread feed-in device of the packaging equipment according to the present invention, in which sliced bread of a half pound sliced to a predetermined number of slices, three slices for example, by a slicer (not shown) is received in a standing state on each of the receiving plates 2 to be conveyed in the feed-in conveyor running direction.

The sliced bread conveyed by the feed-in conveyor 1 is moved by a push bar or scraping bar so that the sliced bread is transferred onto a first supply path 10 or second supply path 20, to be described later, according to respective predetermined unit numbers of bread slices.

Numeral 11 designates a supply conveyor, such as a belt conveyor or the like. The supply conveyor 11 has such a conveyor width that sliced bread of one pound having a predetermined unit number of bread slices (six slices, for example), arranged along a supply conveyor running direction shown by a solid line arrow in FIG. 1, can be conveyed in a standing state of the sliced bread. At upper positions on both sides of the supply conveyor 11, endless guide conveyors 12, 15 are arranged for supporting both sides of sliced bread placed on, and conveyed by, the supply conveyor 11. The guide conveyor 12 is wound around pulleys 13, 14 and the guide conveyor 15 is wound around pulleys 16, 17, both to be driven to run in directions shown by respective solid line arrows in FIG. 1 at the same velocity as the supply conveyor 11. Thereby, the sliced bread on the supply conveyor 11 is guided to be conveyed in the supply conveyor running direction. The supply conveyor 11 and guide conveyors 12, 15 constitute the first supply path 10 that receives and conveys the sliced bread of one pound.

An outlet of the first supply path 10 (on the left side in FIG. 1) is arranged so as to be aligned with a sliced bread receiving path 50 of a packaging apparatus (not shown).

Numeral 20 designates the second supply path having such a width that the sliced bread in a standing state of a half pound (three slices) can be conveyed. A supply path surface 21 of the second supply path 20 is formed having such a smoothed flat surface that the sliced bread easily slides thereon or the supply path surface 21 is formed by a belt conveyor. On both sides of the supply path surface 21, guide members 22, 23 are arranged for supporting and guiding both sides of the sliced bread conveyed on the supply path surface 21.

Figure 2:
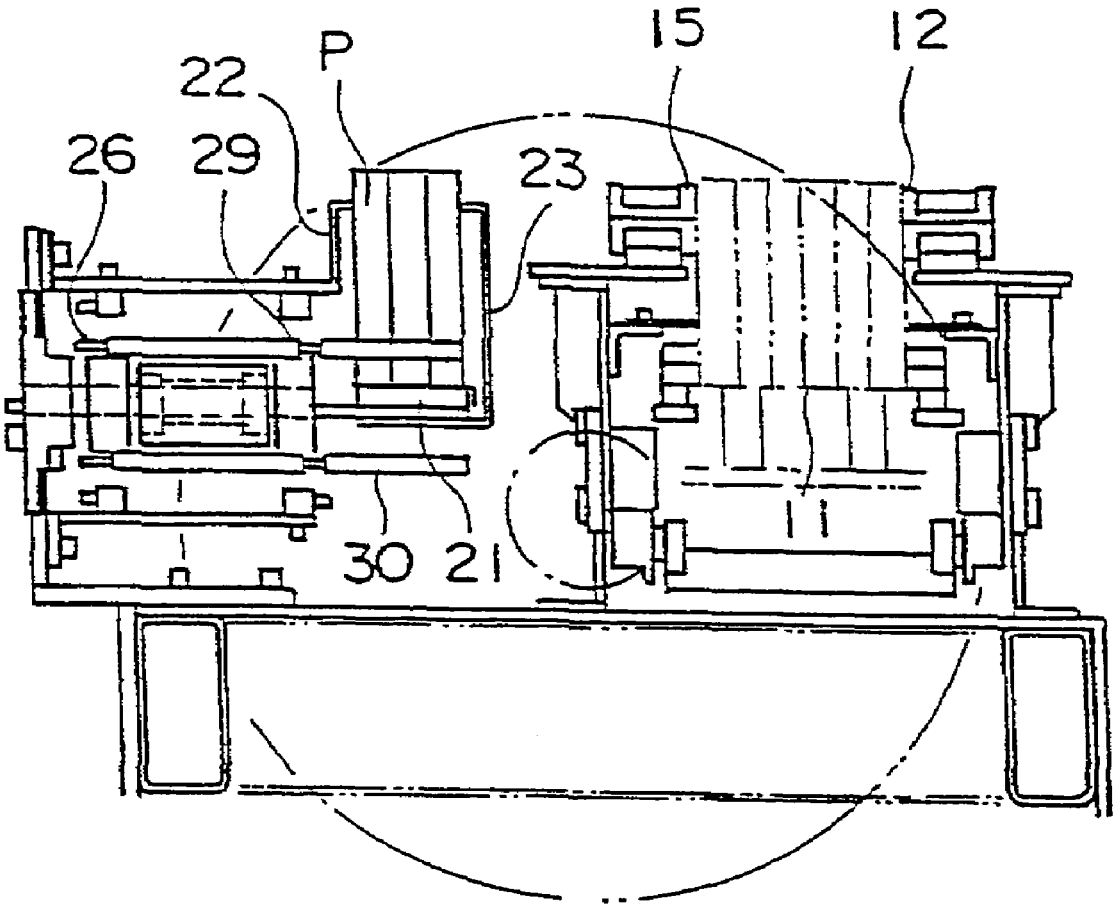
FIG. 2 is a cross sectional view taken on line II-II and seen in an arrow direction of the sliced bread packaging equipment of FIG. 1.

On one side of the second supply path 20, that is, on an upper side in FIG. 1 or on the left side in FIG. 2, an endless chain 26 wound around chain wheels 24, 25, and an endless chain 29 wound around chain wheels 27, 28 are arranged. A plurality of bread feed bars 30 are fitted to the endless chains 26, 29 with a predetermined interval being maintained between each of the bread feed bars 30 so that when the endless chains 26, 29 are driven to run, the bread feed bars 30 function to push sliced bread P (FIG. 2) of a half pound fed onto the second supply path 20 to be conveyed in a direction shown by a solid line arrow in FIG. 1.

Numeral 40 designates an upsetting device arranged between each of outlet sides of the first and second supply paths 10, 20. This upsetting device 40 functions to turn into a laying condition the sliced bread P (FIG. 2) of a half pound fed in the standing state from the second supply path 20 so that slice surfaces of the sliced bread P face upward and downward. Structure of the upsetting device 40 is shown in FIG. 3.

Figure 3:
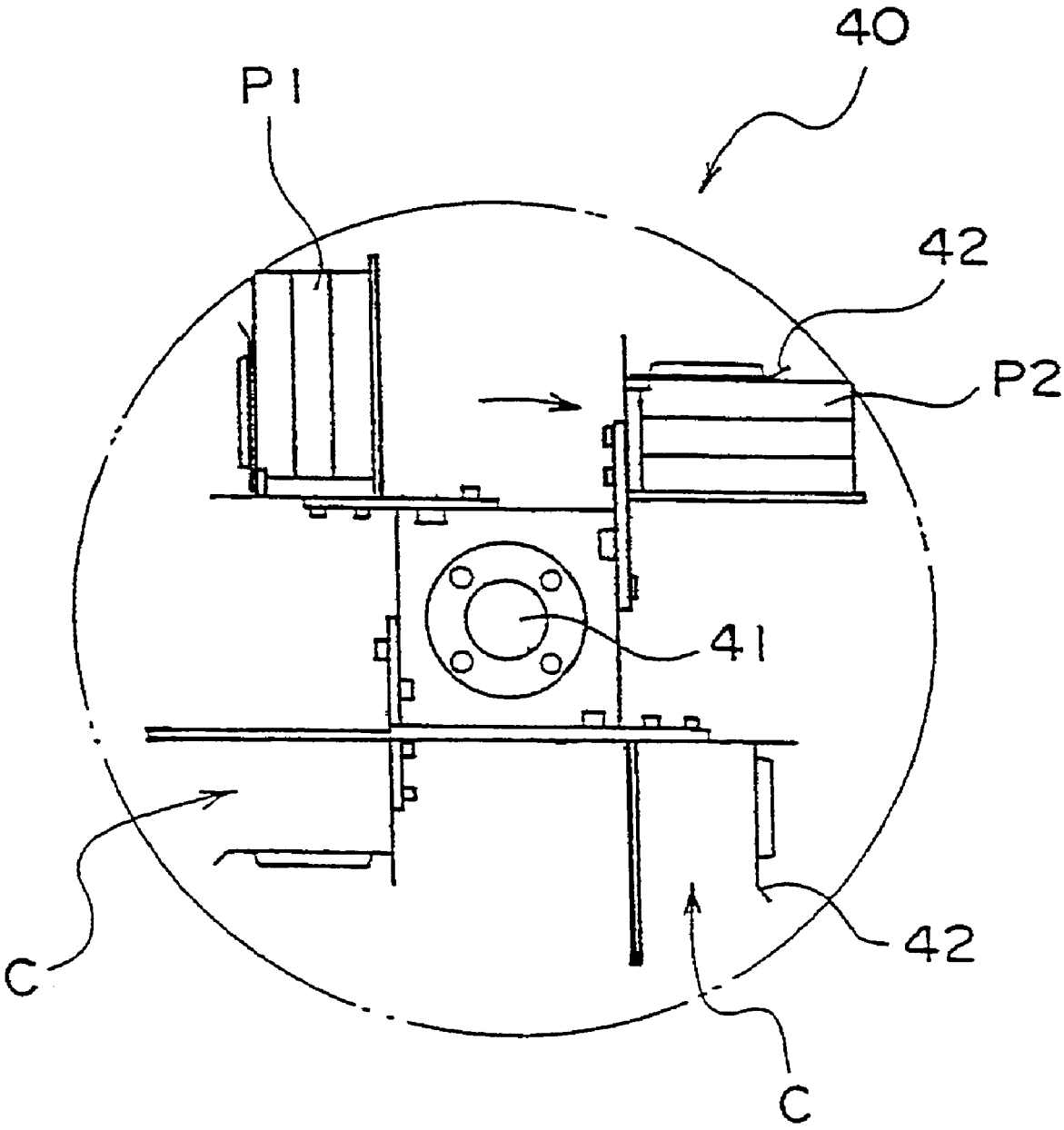
FIG. 3 is a side view of an upsetting device along line III-III and seen in an arrow direction of the sliced bread packaging equipment of FIG. 1.

In FIG. 3, numeral 41 designates a rotating shaft. Four compartments C for receiving sliced bread are fitted to the rotating shaft 41 with an angular interval of 90°. In FIG. 3, numeral 42 designates a spring plate for holding the sliced bread received in compartment C from one side of the sliced bread.

The sliced bread P supplied from the second supply path 20 is received into one of the compartments C of the upsetting device 40 as sliced bread P1 shown in FIG. 3. In this state, the upsetting device 40 is rotated by an angle of 90° around the rotating shaft 41. Thereby, the sliced bread P1 received in this compartment C of the upsetting device 40 is turned into a laying condition so that slice surfaces face upward and downward as sliced bread P2. At this time, the sliced bread P2 is positioned at an outlet portion of the first supply path 10 as shown in FIGS. 1 and 2 so that the sliced bread P2 in a sideways turned state at this position is aligned with the sliced bread receiving path 50 of the packaging apparatus (not shown). Thus, like the sliced bread supplied from the first supply path 10, the sliced bread P2 is fed as it is into the packaging apparatus to be packaged.

In the sliced bread packaging equipment of the embodiment as illustrated having the construction as described above, sliced bread conveyed by the sliced bread feed-in conveyor 1 in a state that the sliced bread of a half pound each is placed on the receiving plate 2 and held by the partitioning plates 3, is fed into an inlet of the first or second supply path 10, 20 (on the right side in FIG. 1) by an appropriate feeding device. Feed of the sliced bread onto the first supply path 10 is performed such that the sliced bread feed-in conveyor 1 is intermittently moved each by a length of two receiving plates 2, and sliced bread of one pound (six slices) on the two receiving plates 2 is fed together onto the first supply path 10. Feed of the sliced bread onto the second supply path 20 is performed such that the sliced bread feed-in conveyor 1 is intermittently moved by a length of one receiving plate 2 and sliced bread of a half pound (three slices) on the one receiving plate 2 is fed onto the second supply path 20.

One or more of units of the sliced bread of one pound fed onto the first supply path 10 are conveyed to the outlet portion of the first supply path 10 by the supply conveyor 11 and guide conveyors 12, 15. On the other hand, one or more of units of the sliced bread of a half pound fed onto the second supply path 20 are conveyed to the outlet portion of the second supply path 20 (on the left side in FIG. 1) by the bread feed bars 30.

The sliced bread of one pound that has passed through the first supply path 10 is discharged onto the sliced bread receiving path 50 of the packaging apparatus (not shown) aligned with the first supply path 10 and is fed into the packaging apparatus to be packaged.

On the other hand, the sliced bread of a half pound that has passed through the second supply path 20 is received into one of the compartments C of the upsetting device 40 arranged on the outlet side of the first and second supply paths 10, 20, as shown by the sliced bread P1 in FIG. 3. The upsetting device 40 is rotated around the rotating shaft 41 by an angle of 90° clockwise in FIG. 3 so that the sliced bread P1 in that compartment C is turned into a laying condition, as shown by the sliced bread P2. As the sliced bread P2 so turned is now in position of the outlet portion of the first supply path 10, the sliced bread P2 is discharged onto the sliced bread receiving path 50 of the packaging apparatus (not shown) aligned with the first supply path 10 and is fed into the same packaging apparatus to be packaged.

It is to be noted that while a detailed description of the packaging apparatus of the sliced bread is omitted, it can be appropriately selected from generally known packaging apparatuses, such as a bag packaging apparatus as disclosed by Japanese laid-open patent applications 1994-286704 and 2001-315716 as one example.

According to the sliced bread packaging equipment of the present invention as described above, by changing over supply of the sliced bread between the first and second supply paths 10, 20, the sliced bread of one pound or a half pound can be selected to be fed into the same packaging apparatus. Moreover, sliced bread, having such a small number of slices that self-support is difficult, fed via the second supply path 20 is supplied into the packaging apparatus in a state that the sliced bread is turned into a laying condition by the upsetting device 40. Thus, regardless of a number of slices to be packaged, a stable and beautiful packaging becomes possible.

In the above, while the sliced bread packaging equipment according to the present invention has been concretely described based on the embodiment, the present invention is not limited thereto but, needless to mention, may be added with various variations or modifications as come within the scope of herein appended claims.

For example, while the apparatus of the above embodiment has been described such that the first supply path 10 conveys sliced bread of one pound and the second supply path 20 conveys sliced bread of a half pound, there is no specific limitation in the sliced bread quantity to be conveyed by the first and second supply paths 10, 20.

Also, while the sliced bread of one pound is illustrated by an example having six slices, there is no specific limitation in the number of slices.

Further, while the apparatus of the embodiment has been described as constructed such that feed of the sliced bread from the first supply path 10 is performed by the supply conveyor 11 and guide conveyors 12, 15, and feed of the sliced bread from the second supply path 20 is performed by the bread feed bars 30, the feed mechanism of the first supply path 10 may be constructed, for example, by the bread feed bars as in the second supply path 20 and the feed mechanism of the second supply path 20 may be constructed by a supply conveyor. That is, the sliced bread conveying device on the supply path is not limited to the ones as illustrated but may be employed from appropriate conveying devices if such conveying devices can smoothly convey sliced bread on the supply path.

Also, while the structure of the upsetting device 40 of the embodiment has been described as having four compartments C with an angular interval of 90°, the number of the compartments C is not limited to four but may be an appropriate number of plural pieces other than four.

Moreover, the upsetting device to be employed in the present invention is not limited to such a rotating type as illustrated, but may be employed from other upsetting devices having an appropriate structure if such upsetting devices can smoothly turn into a laying condition sliced bread in a standing state, such as an upsetting device having a structure as disclosed by Japanese laid-open patent application 1994-278841.

What is claimed is:

1. Sliced bread packaging equipment comprising:

a first supply path for conveying at least one first unit of sliced bread in a sliced bread standing state, with each first unit having a first plurality of bread slices;

a second supply path for conveying at least one second unit of sliced bread in the sliced bread standing state, with each second unit having a second plurality of bread slices that is less than the first plurality of bread slices; and an upsetting device for receiving the at least one second unit of sliced bread from said second supply path and changing a posture of the at least one second unit of sliced bread from the sliced bread standing state to a sliced bread laying state, such that the at least one first unit of sliced bread in the sliced bread standing state can be fed into a sliced bread packaging apparatus, and the at least one second unit of sliced bread in the sliced bread laying state can be fed into the sliced bread packaging apparatus.

2. The sliced bread packaging equipment according to claim 1, further comprising:

a sliced bread feed-in device for supplying the sliced bread in the sliced bread standing state to said first supply path and said second supply path.

3. The sliced bread packaging equipment according to claim 2, wherein the at least one first unit of sliced bread in the sliced bread standing state is to be fed into the sliced bread packaging apparatus from said first supply path, and said upsetting device is also for positioning the at least one second unit of sliced bread at said first supply path in the sliced bread laying state, such that the at least one second unit of sliced bread in the sliced bread laying state is to be fed into the sliced bread packaging apparatus from said first supply path.

4. The sliced bread packaging equipment according to claim 3, wherein said upsetting device is rotatable and includes at least one section for receiving the at least one second unit of sliced bread in the sliced bread standing state when supplied from said second supply path, such that said upsetting device is for receiving the at least one second unit of sliced bread from said second supply path and changing the posture of the at least one second unit of sliced bread from the sliced bread standing state to the sliced bread laying state by receiving the at least one second unit of sliced bread in the at least one section from said second supply path and then rotating said upsetting device by a predetermined angle.

5. The sliced bread packaging equipment according to claim 4, wherein said upsetting device is rotatable about an axis that is parallel to said first supply path and said second supply path.

6. The sliced bread packaging equipment according to claim 5, wherein said first supply path is constructed to be aligned with a sliced bread receiving path of the sliced bread packaging apparatus, and said upsetting device is for positioning the at least one second unit of sliced bread in the sliced bread laying state at said first supply path by positioning the at least one second unit of sliced bread in the sliced bread laying state at an outlet portion of said first supply path.

7. The sliced bread packaging equipment according to claim 6, wherein each first unit of sliced bread comprises one pound of the sliced bread, and each second unit of sliced bread comprises a half pound of the sliced bread.

8. The sliced bread packaging equipment according to claim 3, wherein each first unit of sliced bread comprises one pound of the sliced bread, and each second unit of sliced bread comprises a half pound of the sliced bread.

9. The sliced bread packaging equipment according to claim 3, wherein said first supply path is constructed to be aligned with a sliced bread receiving path of the sliced bread packaging apparatus, and said upsetting device is for positioning the at least one second unit of sliced bread in the sliced bread laying state at said first supply path by positioning the at least one second unit of sliced bread in the sliced bread laying state at an outlet portion of said first supply path.

10. The sliced bread packaging equipment according to claim 4, wherein each first unit of sliced bread comprises one pound of the sliced bread, and each second unit of sliced bread comprises a half pound of the sliced bread.

11. The sliced bread packaging equipment according to claim 4, wherein said first supply path is constructed to be aligned with a sliced bread receiving path of the sliced bread packaging apparatus, and said upsetting device is for positioning the at least one second unit of sliced bread in the sliced bread laying state at said first supply path by positioning the at least one second unit of sliced bread in the sliced bread laying state at an outlet portion of said first supply path.

12. The sliced bread packaging equipment according to claim 1, wherein said upsetting device is rotatable and includes at least one section for receiving the at least one second unit of sliced bread in the sliced bread standing state when supplied from said second supply path, such that said upsetting device is for receiving the at least one second unit of sliced bread from said second supply path and changing the posture of the at least one second unit of sliced bread from the sliced bread standing state to the sliced bread laying state by receiving the at least one second unit of sliced bread in the at least one section from said second supply path and then rotating said upsetting device by a predetermined angle.

13. The sliced bread packaging equipment according to claim 12, wherein said upsetting device is rotatable about an axis that is parallel to said first supply path and said second supply path.

14. The sliced bread packaging equipment according to claim 1, wherein the at least one first unit of sliced bread in the sliced bread standing state is to be fed into the sliced bread packaging apparatus from said first supply path, and said upsetting device is also for positioning the at least one second unit of sliced bread at said first supply path in the sliced bread laying state, such that the at least one second unit of sliced bread in the sliced bread laying state is to be fed into the sliced bread packaging apparatus from said first supply path.

15. A method of packaging sliced bread, comprising:

conveying at least one first unit of sliced bread in a sliced bread standing state along a first supply path, with each first unit having a first plurality of bread slices;

conveying at least one second unit of sliced bread in the sliced bread standing state along a second supply path, with each second unit having a second plurality of bread slices that is less than said first plurality of bread slices;

using an upsetting device to receive said at least one second unit of sliced bread from said second supply path and change a posture of said at least one second unit of sliced bread from the sliced bread standing state to a sliced bread laying state;

feeding said at least one first unit of sliced bread in the sliced bread standing into a sliced bread packaging apparatus; and feeding said at least one second unit of sliced bread in the sliced bread laying state into said sliced bread packaging apparatus.

16. The method according to claim 15, wherein feeding said at least one first unit of sliced bread in the sliced bread standing into a sliced bread packaging apparatus comprises feeding said at least one first unit of sliced bread in the sliced bread standing into the sliced bread packaging apparatus from said first supply path, and further comprising:

using said upsetting device to position said at least one second unit of sliced bread at said first supply path in the sliced bread laying state, such that feeding said at least one second unit of sliced bread in the sliced bread laying state into said sliced bread packaging apparatus comprises feeding said at least one second unit of sliced bread in the sliced bread standing into said sliced bread packaging apparatus from said first supply path.

17. The method according to claim 16, wherein said upsetting device is rotatable an axis that is parallel to said first supply path and said second supply path and includes at least one section for receiving said at least one second unit of sliced bread in the sliced bread standing state from said second supply path, such that using said upsetting device to receive said at least one second unit of sliced bread from said second supply path and change the posture of said at least one second unit of sliced bread from the sliced bread standing state to the sliced bread laying state comprises receiving said at least one second unit of sliced bread in the at least one section from said second supply path and then rotating said upsetting device about said axis by a predetermined angle.

18. The method according to claim 15, wherein said upsetting device is rotatable and includes at least one section for receiving said at least one second unit of sliced bread in the sliced bread standing state from said second supply path, such that using said upsetting device to receive said at least one second unit of sliced bread from said second supply path and change the posture of said at least one second unit of sliced bread from the sliced bread standing state to the sliced bread laying state comprises receiving said at least one second unit of sliced bread in the at least one section from said second supply path and then rotating said upsetting device by a predetermined angle.

19. The method according to claim 18, wherein rotating said upsetting device by a predetermined angle comprises rotating said upsetting device by the predetermined angle about an axis that is parallel to said first supply path and said second supply path.

20. The method according to claim 15, further comprising:

supplying the sliced bread in the sliced bread standing state to said first supply path and said second supply path.

* * * * *